US011641915B1

(12) United States Patent
Smith

(10) Patent No.: US 11,641,915 B1
(45) Date of Patent: May 9, 2023

(54) ROOFING WALKING STICK AND METHOD OF USE

(71) Applicant: Hope M Smith, Sierra Vista, AZ (US)

(72) Inventor: Hope M Smith, Sierra Vista, AZ (US)

( * ) Notice: Subject to any disclaimer, the term of this patent is extended or adjusted under 35 U.S.C. 154(b) by 0 days.

(21) Appl. No.: 17/118,298

(22) Filed: Dec. 10, 2020

Related U.S. Application Data

(63) Continuation-in-part of application No. 16/595,467, filed on Oct. 8, 2019, now Pat. No. 10,925,359.

(51) Int. Cl.
*A45B 9/04* (2006.01)
*E04D 13/12* (2006.01)

(52) U.S. Cl.
CPC ..... *A45B 9/04* (2013.01); *E04D 13/12* (2013.01); *A45B 2200/05* (2013.01)

(58) Field of Classification Search
CPC ..... A45B 9/04; E04D 13/12
See application file for complete search history.

(56) References Cited

U.S. PATENT DOCUMENTS 383,378 A * 5/1888 Smith ..... A45B 9/04 135/77
2,453,742 A * 11/1948 Bowen ..... A61H 3/0288 135/77
5,197,501 A * 3/1993 Ragatz ..... A45B 3/00 135/66
5,492,141 A * 2/1996 Oberlander ..... A62B 35/0056 135/65
5,727,584 A * 3/1998 Stanec ..... A45B 9/04 135/65
6,098,239 A * 8/2000 Vosbikian ..... A47L 13/254 15/228
6,513,184 B1 * 2/2003 Brown ..... B32B 5/22 15/231
7,047,990 B2 * 5/2006 Zambrano ..... A45B 1/00 135/82
9,226,556 B1 * 1/2016 Chien ..... A45B 9/04
10,506,906 B2 * 12/2019 Pellegrino ..... A47L 13/12

* cited by examiner

*Primary Examiner* — Noah Chandler Hawk
(74) *Attorney, Agent, or Firm* — Richard Eldredge; Eldredge Law Firm

(57) ABSTRACT

A roofing walking stick for providing stability during navigation on the roof of a structure, the system providing a roofing walking stick having of a handle, elongated shaft, one or more joint couplings, and a base; wherein the one or more joint couplings are configured to allow the elongated shaft to rotatably articulate relative to the base; wherein the base provides grip when in contact with the roof.

1 Claim, 5 Drawing Sheets

ROOFING WALKING STICK AND METHOD OF USE

CROSS REFERENCE TO RELATED APPLICATIONS

This application is a continuation-in-part of U.S. patent application Ser. No. 16/595,467 filed Oct. 8, 2019, which is a nonprovisional parent application of, and claims the benefit to, U.S. Provisional Patent Application No. 67/742,452, filed Oct. 8, 2018, the disclosures of which are hereby incorporated herein in their entirety.

BACKGROUND

1. Field of the Invention

The present invention relates generally to stability aid systems, and more specifically to a roofing walking stick system that provides for improved stability for users while performing tasks on roofs with varying sloped surfaces.

2. Description of Related Art

Stability aid systems are well known in the art and are effective means to provide stability during user movement. Commonly in the art, stability aid systems utilize walking sticks or walking canes to help individuals move safely and easily. However, conventional walking sticks are limited to helping individuals suffering from afflictions (e.g., age, medical conditions, or the like) walk along flat surfaces. There is a need to provide a walking stick which provides increased stability for the user while navigating on sloped surfaces such as a pitched roof.

Many individuals (roofers, home inspectors, homeowners, and the like) walk on pitched roofs of structures for various tasks. Pitched roofs can be perilous and difficult to balance on and to maneuver when walking thereon. Typically, individual employ stability aids such as rope and harness systems, roof ladders with ridge hooks, roof jacks with support beams, and the like to safely navigate on pitched roofs. While these stability aids focus on fall prevention or lessening injury from a fall, these stability aids are cumbersome to set up and sometimes result in physical damage to structures during use.

Hence, it would be advantageous to have a system that provides for improved stability for a user while maneuvering on pitched roofs of structures without causing physical damage to said structures during employment.

Accordingly, although great strides have been made in the area of stability aid systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
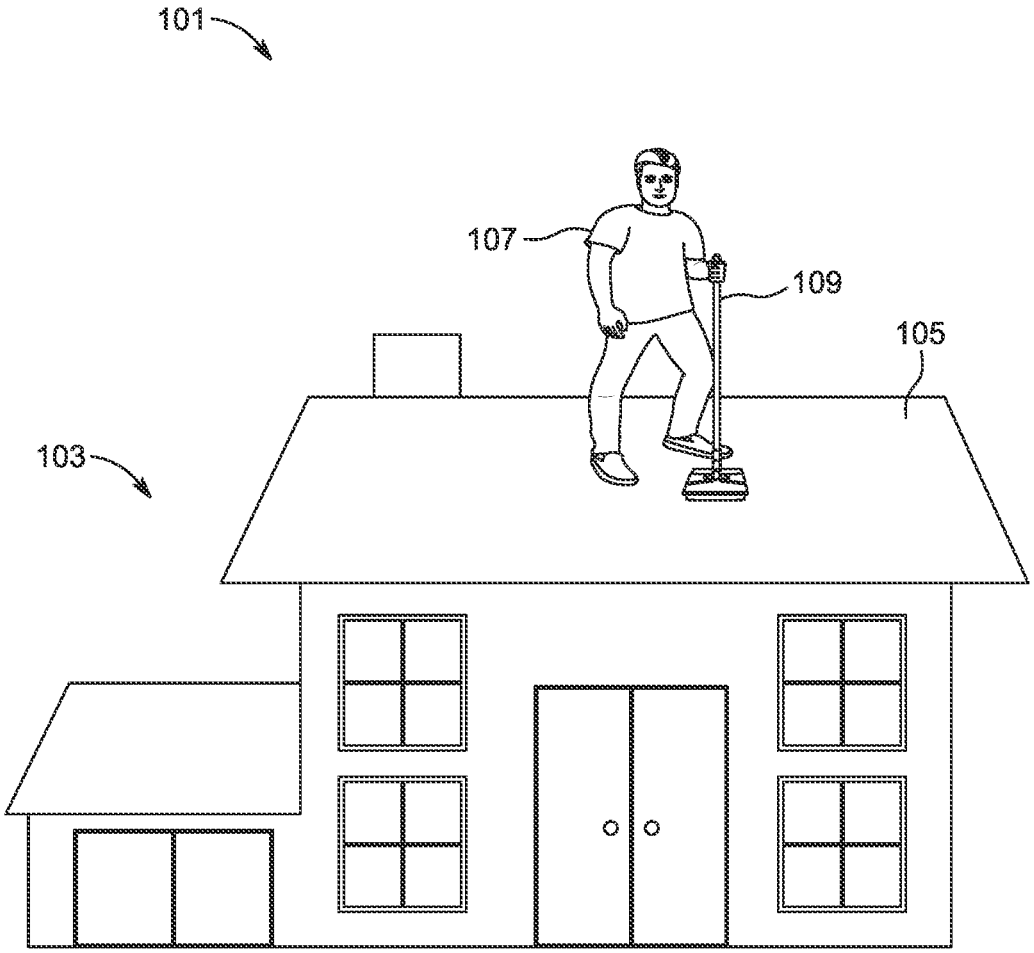
FIG. 1 is a schematic of a roofing walking stick system in use in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional stability aids. Specifically, the system of the present invention provides a roofing walking stick capable of stabilizing a user performing various tasks on the roof of a structure. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Reference in the specification to "structure" or "structures" means a building having a roof and walls.

Referring now to the drawings wherein like reference characters identify corresponding or similar elements throughout the several views, FIG. 1 depicts a schematic of a roofing walking stick system 101 in accordance with a preferred embodiment of the present application. It will be appreciated that the roofing walking stick system 101 overcomes one or more of the above-listed problems commonly associated with conventional stability aid systems. It should also be appreciated that the roofing walking stick system 101 may vary based on aesthetical, functional, or manufacturing considerations.

In the contemplated embodiment, the roofing walking stick system 101 includes a structure 103 having a roof 105, a user 107, and a roofing walking stick 109 (details discussed further below in FIGS. 2-4).

It should be appreciated that the structure 103 can be any type of building including, without limitation, a residential home, a multifamily housing, a commercial building, a factory, a warehouse, a farmhouse, a shed, and a garage.

In addition, it should be appreciated that the roof 105 can include any shape, angle, form, or the like including, without limitation, flat, mono-pitched, pent, multi-pitched, circular, hyperbolic, and the like. Examples of common roof shapes include, but are not limited to, gable, hip, half hip, gambrel, flat, shed, mansard, dome, saddleback, pagoda, butterfly, Dutch gable, witch hat, and cat slide.

Likewise, it should be appreciated that the roof 105 can be made of any material including, without limitation, wood, thatch, slate, metal (e.g., aluminum, steel, copper), asphalt, clay, concrete, transparent materials (e.g., glass, polycarbonate), synthetic materials (rubber, plastic, polymer), or a combination thereof.

The user 107 includes one or more persons, one or more businesses, or a combination thereof interacting with system 101. Examples of businesses include, without limitation, financial institutions, corporations, partnerships, limited liability companies, and other business entities. In one example, the user can be an agent of a roofing company assigned to inspect the roof of a residential home.

It should be appreciated that during use, the user 107 operates the roofing walking stick 109 to navigate and maneuver on the roof 105. During operation, the roofing walking stick 109 provides stability for the user 107 without causing physical damage to the roof 105.

Figure 2:
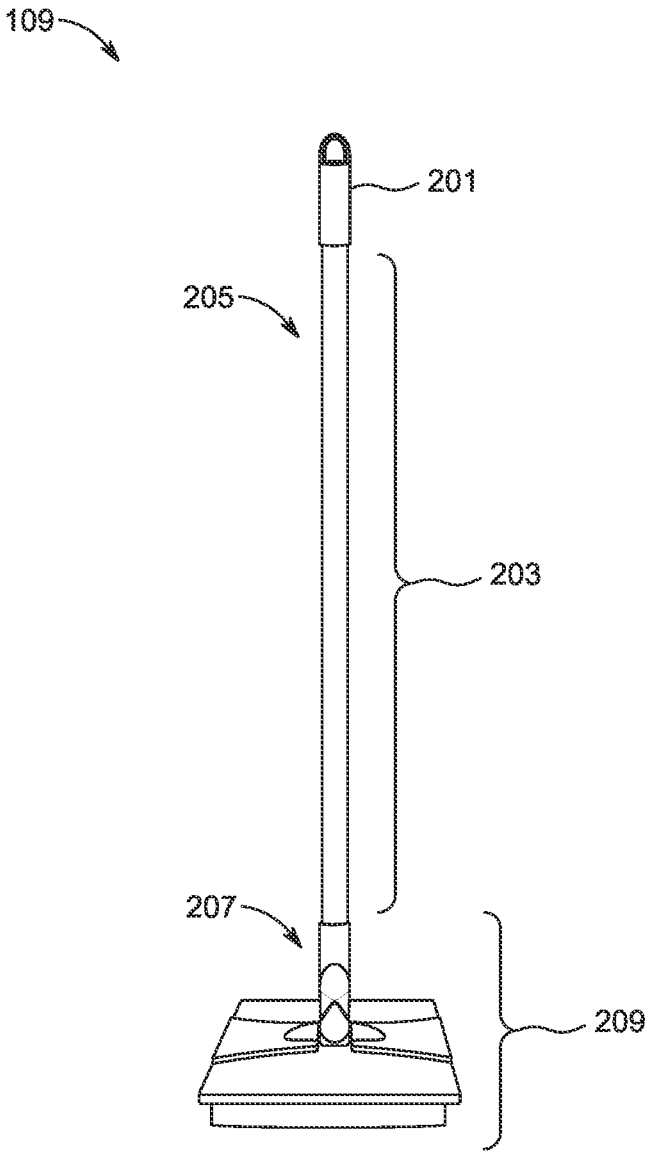
FIG. 2 is a front view of the roofing walking stick of FIG. 1 in accordance with one or more embodiments of the present application.

In FIG. 2, a front view of the roofing walking stick 109 is depicted. As shown, the roofing walking stick 109 comprises of a handle 201, an elongated shaft 203 having a proximal end 205 and a distal end 207, and a base 209. The handle 201 removably couples to the proximal end 205 of the elongated shaft 203. The base 209 removably couples to the distal end 207 of the elongated shaft 203. In some embodiments, the elongated shaft 203 is telescopic, providing for easy storage and allowing the user 207 to adjust the roofing walking stick 109 to a length suitable for the user 207.

It should be appreciated that although the elongated shaft 203 is shown having a cylindrical shape, it is contemplated that the elongated shaft 203 can vary in shape such as square, triangular, circular, polygonal, starlike, or the like. Likewise, it should be appreciated that the elongated shaft 203 can vary in size, style, and the like. Further, it should be appreciated that the configuration of the elongated shaft 203 prevents the elongated shaft 203 from displacing when laid down on a roof surface.

Figure 3:
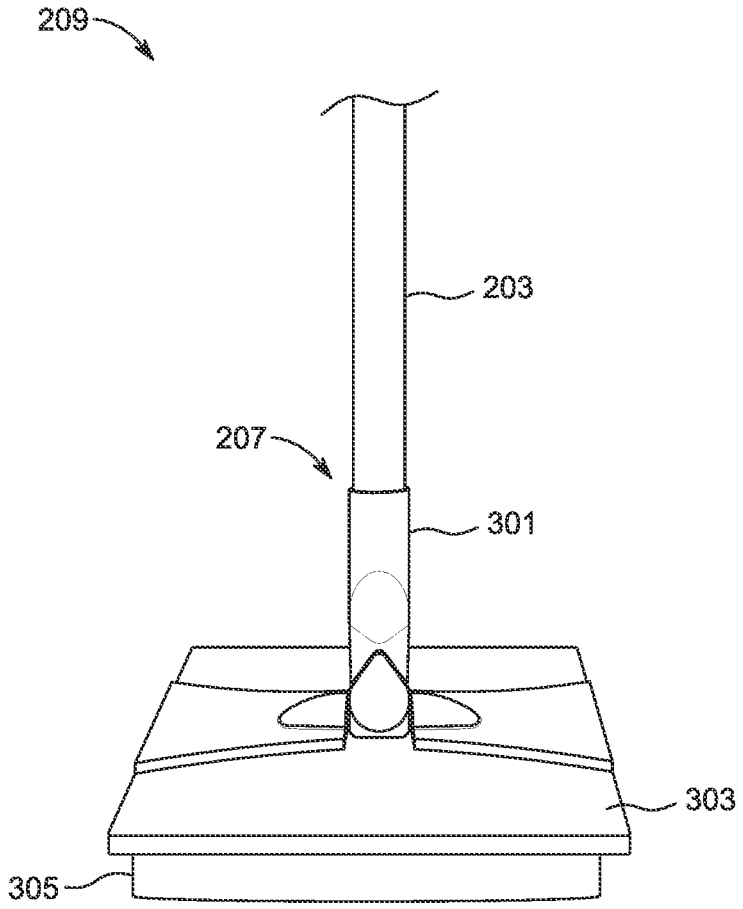
FIG. 3 is a close-up view of the base of the roofing walking stick of FIG. 1 in accordance with one or more embodiments of the present application.

In FIG. 3, a front view of the base 209 of the roofing walking stick 109 is depicted. As shown, the base 209 comprises of one or more joint couplings 301, a top portion 303, and a bottom portion 305 (details discussed further in FIG. 4). The one or more joint couplings 301 are removably attached to the distal end 207 of the elongated shaft 203. The one or more joint couplings 301 are further rotatably and removably attached to the top portion 303 of the base 209. The one or more joint couplings 301 are configured to allow the elongated shaft 203 to articulate relative to the base 209 in multiple directions, including 0° through 180° angles, as depicted with directional arrows. The bottom portion 305 is removably coupled to the top portion 303 of the base 209. The bottom portion 305 is configured to provide grip when in contact with the surface of a roof.

It should be appreciated that although the base 209 is shown having a rectangular shape, it is contemplated that the base 209 can vary in shape such as square, triangular, circular, polygonal, starlike, or the like. Likewise, it should be appreciated that the base 209 can vary in size, style, and the like.

Figure 4:
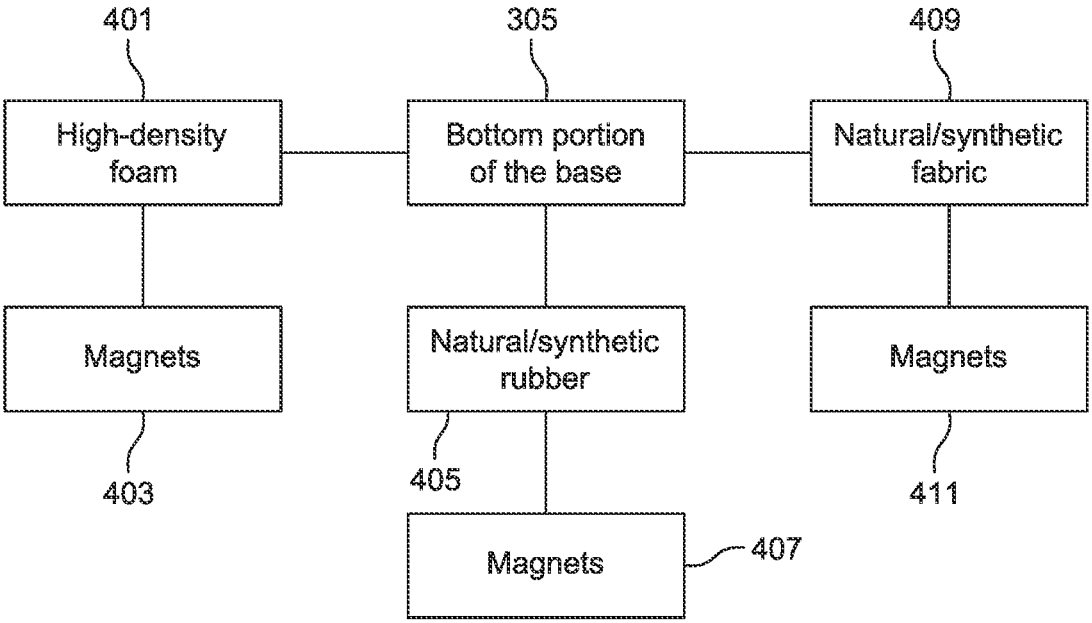
FIG. 4 is a simplified schematic of features associated with the bottom portion of the base of the roofing walking stick of FIG. 1 in accordance with one or more embodiments of the present application.

In FIG. 4, a simplified schematic depicts features contemplated with the bottom portion 305. These features allow the bottom portion 305 to provide further grip along the surface of a roof. In some embodiments, the bottom portion 305 may include high-density foam 401, magnets 403, or a combination thereof. In other embodiments, the bottom portion 305 may include natural rubber and/or synthetic rubber 405, magnets 407, or a combination thereof. Examples of synthetic rubber include neoprene, butyl, butadiene, and styrene-butadiene. In alternative embodiments, the bottom portion may include natural and/or synthetic fabric 409, magnets 411, or a combination thereof. Examples of synthetic fabric 409 include polyester and polyester blend. It should be appreciated that magnets 403, 407, 409 provide further stability during use, especially on roofs made of metal material. In addition, it should be appreciated that magnets 403, 407, 409 include materials having ferromagnetic or ferrimagnetic properties.

It should be appreciated that one of the unique features believed characteristic of the present application is the inclusion of the shaft, base, and joint coupling that allow for improved stability during navigation on a roof.

Figure 5:
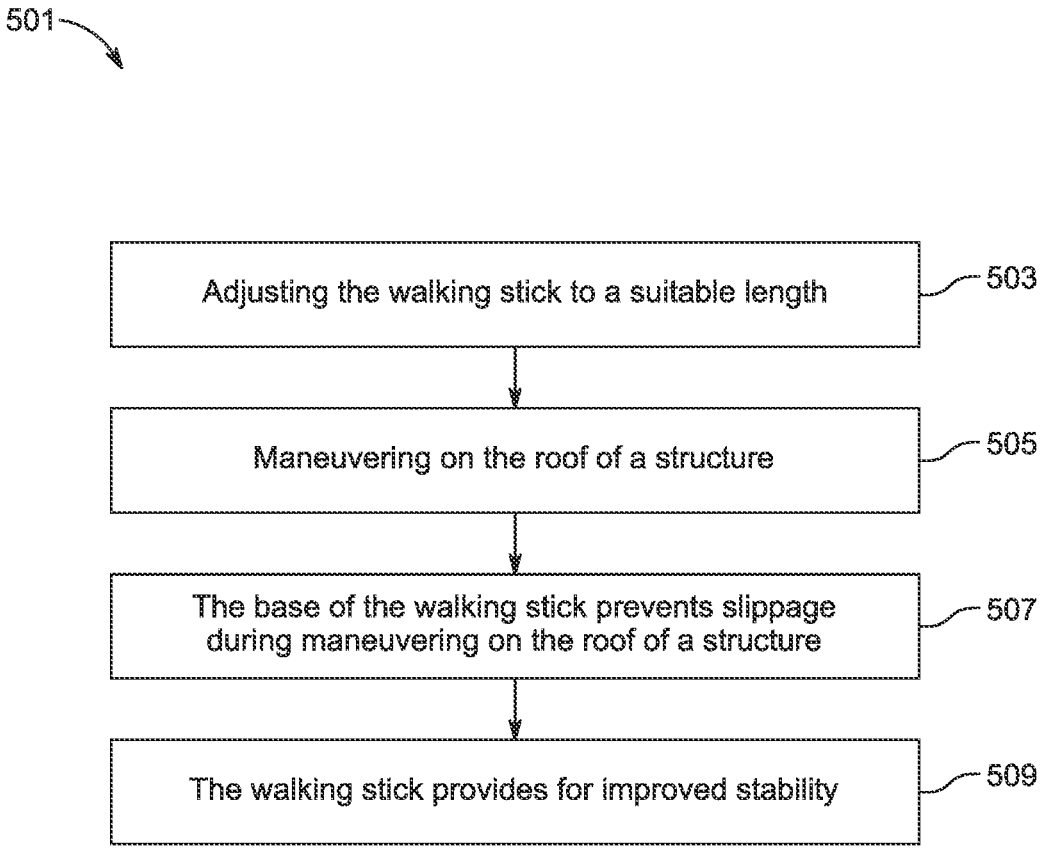
FIG. 5 is a flowchart of a method of use of the system of FIG. 1.

In FIG. 5 is a flowchart of a method of use of the system of FIG. 1. During use, the user adjusts the roofing walking stick to a suitable length, as shown with box 503. As the user maneuvers on the roof of a structure, the base of the roofing walking stick prevents slippage during maneuvering, as shown with boxes 505, 507. The roofing walking stick provides for improved stability, as shown with box 509.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A roofing walking stick system, comprising:

a structure, the structure having a roof and one or more walls;

a walking stick, the walking stick having:

a handle;

an elongated shaft having a proximal end and a distal end;

one or more joint couplings; and a base;

wherein the handle couples to the proximal end of the elongated shaft;

wherein the one or more joint couplings attach to the distal end of the elongated shaft;

wherein the base couples to the distal end of the elongated shaft via the one or more joint couplings;

wherein the one or more joint couplings are configured to rotatably articulate the elongated shaft relative to the base at one or more angles;

wherein the walking stick provides stability during navigation on the roof of the structure;

wherein the one or more angles includes ranges of 0 degree through 180 degrees; and wherein the base further comprises:

a top portion;

and a bottom portion coupled to the top portion;

wherein the top portion receives and secures the one or more joint couplings therein; and wherein the bottom portion is configured to provide grip along the surface of a roof;

wherein the bottom portion further comprises of high-density foam material, magnet material, or a combination thereof.

* * * * *